US005678141A

United States Patent [19]

Asano et al.

[11] Patent Number: 5,678,141

[45] Date of Patent: Oct. 14, 1997

[54] CHARGING APPARATUS AND PROCESS CARTRIDGE

[75] Inventors: Erika Asano, Tokyo; Hiroki Kisu, Kanagawa-ken; Michihito Yamazaki, Tokyo; Hiroaki Ogata, Kawasaki, all of Japan

[73] Assignee: Canon Kabushiki Kaisha, Tokyo, Japan

[21] Appl. No.: 271,673

[22] Filed: Jan. 30, 1994

[30] Foreign Application Priority Data

Jul. 7, 1993 [JP] Japan ..... 5-193094

[51] Int. Cl.[6] ..... G03G 15/02

[52] U.S. Cl. ..... 399/115; 361/225; 399/168

[58] Field of Search ..... 355/219, 271, 355/274; 361/221, 225; 399/115, 168

[56] References Cited

U.S. PATENT DOCUMENTS

| | | | |
|---|---|---|---|
| 3,754,963 | 8/1973 | Chang | 430/120 |
| 3,853,556 | 12/1974 | Severynse | 430/48 |
| 3,976,370 | 8/1976 | Goel et al. | 355/315 |
| 4,371,252 | 2/1983 | Uchida et al. | 355/219 |
| 4,851,960 | 7/1989 | Nakamura et al. | 361/225 |
| 5,055,878 | 10/1991 | Okamoto et al. | 355/219 |
| 5,177,534 | 1/1993 | Kisu et al. | 355/219 |
| 5,249,022 | 9/1993 | Watanabe et al. | 355/271 |
| 5,475,471 | 12/1995 | Kisu et al. | 355/219 |

FOREIGN PATENT DOCUMENTS

| | | |
|---|---|---|
| 62-49374 | 3/1987 | Japan . |
| 4-75071 | 3/1992 | Japan . |

OTHER PUBLICATIONS

Patent Abstracts of Japan, vol. 16, No. 281 (P–1375) (5324), Jun. 23, 1992.

Patent Abstracts of Japan, vol. 11, No. 239 (P–602), Aug. 6, 1987.

*Primary Examiner*—William J. Royer

*Attorney, Agent, or Firm*—Fitzpatrick, Cella, Harper & Scinto

[57] ABSTRACT

A charging apparatus includes a charging surface for charging a member to be charged, wherein a voltage is applied between the charging apparatus and the member to be charged; and projections for contacting the charging apparatus substantially at three positions to the member to be charged to closely face a charging surface to the member to be charged.

23 Claims, 9 Drawing Sheets

CHARGING APPARATUS AND PROCESS CARTRIDGE

FIELD OF THE INVENTION AND RELATED ART

The present invention relates to a charging apparatus and a process cartridge for charging a member to be charged such as a photosensitive member or a dielectric member.

Heretofore, in an image forming apparatus such as an electrophotographic apparatus (copying machine), laser beam printer, or the like, or an electrostatic recording apparatus, corona discharges are widely used as a means for electrically charging or discharging am ember to be charged such as the photosensitive member or the dielectric member, by which the surface of the member to be charged is exposed to corona produced by the corona discharger.

Recently, a contact type charging means has been developed, in which a charging member (conductive member) in the form of a roller or blade is supplied with a voltage, and is contacted to the member to be charged, by which the surface is charged.

Here, the charging member is not necessarily contacted to the surface to be charged. The non-contact (proximity) is usable if a dischargeable region determined by a gap voltage and a corrected Paschen's curve is assured between the charging member and the surface to be charged.

As contrasted to the corona discharging device comprising a wire and a shield, the contact or proximity charging is advantageous in that the voltage required for charging the surface to be charged to a predetermined level can be reduced, that the amount of ozone produced in the charging process is very small so that the necessity for an ozone removing filter is eliminated, that the exhausting system can be simplified, the maintenance operation is not required, and the structure is made simple.

As proposed in U.S. Pat. No. 4,851,960 regarding the contact or proximity charging, which has been assigned to the assignee of this application, it is preferable from the standpoint of uniform charging (discharging) that an oscillating voltage, particularly, an oscillating voltage having a peak-to-peak voltage not less than twice a charge starting voltage at which the charging start for the member to be charged only when a DC voltage is applied, is applied to the charging member (oscillating voltage application type, i.e., AC application type).

With such an apparatus, the member to be charged or the image bearing member and the charging member are contacted with the result of tendency of toner or the like fusing on the image bearing member. If this occurs, improper charging may occur. With long time use with the charging member kept in contact with the image bearing member, the surface of the image bearing member or the surface of the charging member is worn with the result of improper charging. The improper charging may result in improper image formation.

In order to prevent improper charging, the charging member and the member to be charged are preferably disposed close to each other. However, a small gap is preferable between the charging member and the member to be charged to reduce the voltage applied to the charging member. If the small gap is not maintained correctly, improper charging may occur.

SUMMARY OF THE INVENTION

Accordingly, it is a principal object of the present invention to provide a charging apparatus and a process cartridge in which improper charging is removed.

It is another object of the present invention to provide a charging apparatus and a process cartridge in which the member to be charged and the charging surface of the charging member are disposed close to each other.

It is a further object of the present invention to provide a charging apparatus and a process cartridge in which the distance between the member to be charged and the charging surface of the charging member is accurate.

It is a further object of the present invention to provide a charging apparatus and a process cartridge in which deposition of foreign matters on the surface of the member to be charged and wearing of the member to be charged or the charging member, is suppressed.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 1(*a*) through 10(*h*) are graphs of results of surface potentials of photosensitive drums.

DESCRIPTION OF THE PREFERRED EMBODIMENTS

The embodiments of the present invention will be described in conjunction with the accompanying drawings.

Figure 1A:
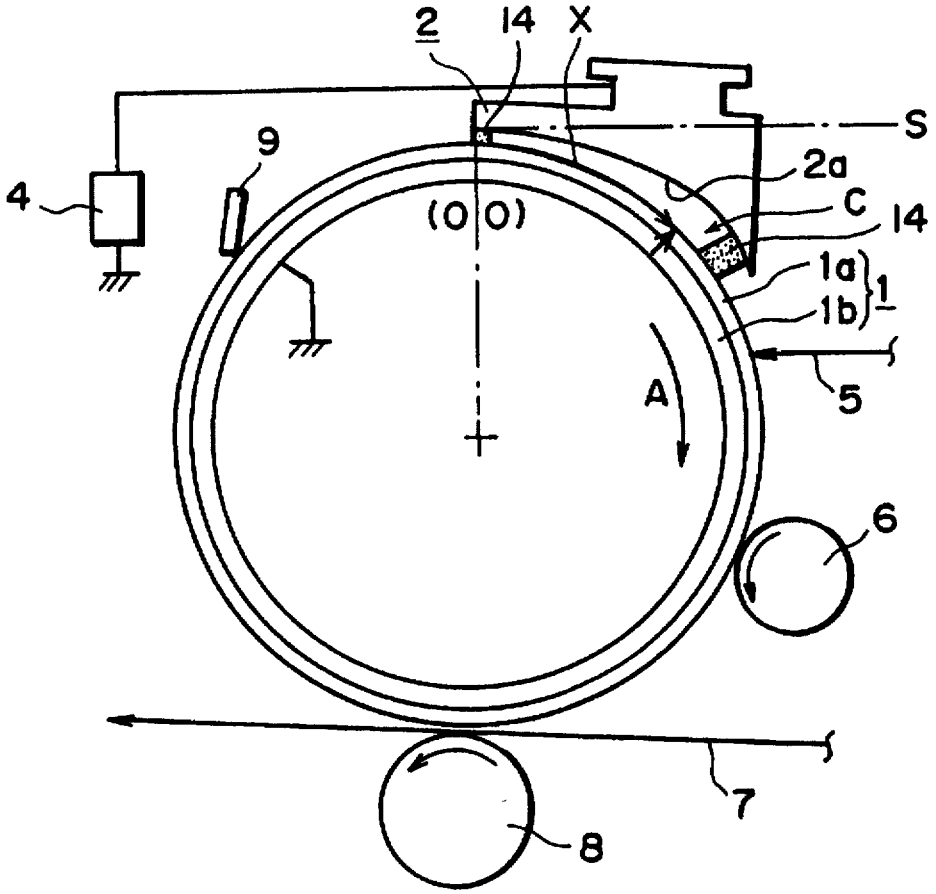
FIG. 1A illustrates a charging member used with an image forming apparatus according to a first embodiment of the present invention.
Figure 1B:
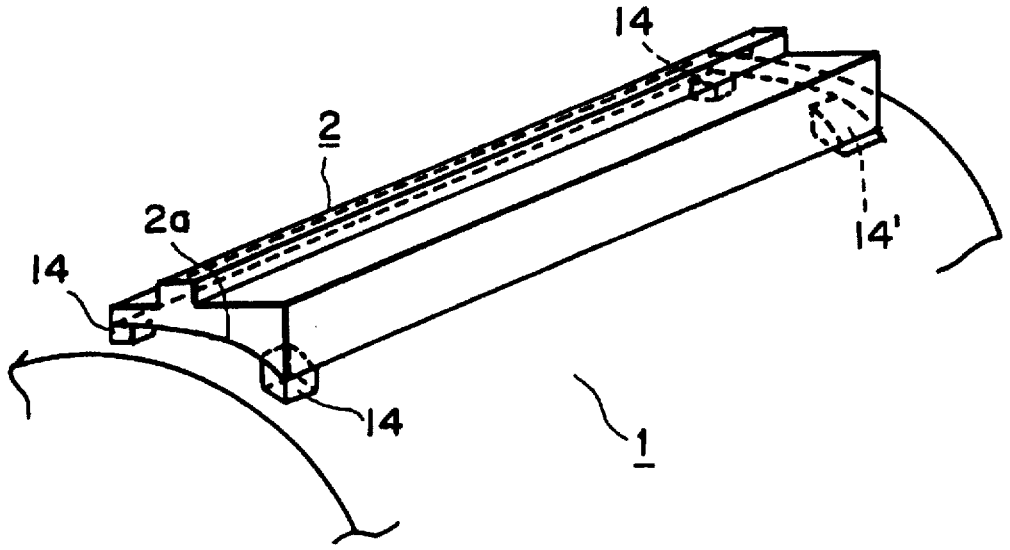
FIG. 1B is a perspective view illustrating a positional relationship between the photosensitive drum and the charging member.
Figure 2A:
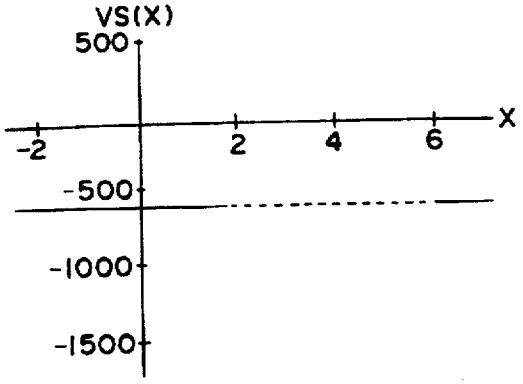
FIGS. 2(*a*) through 2(*f*) are graphs of results of simulation of the surface potential of the photosensitive drum.
Figure 2D:
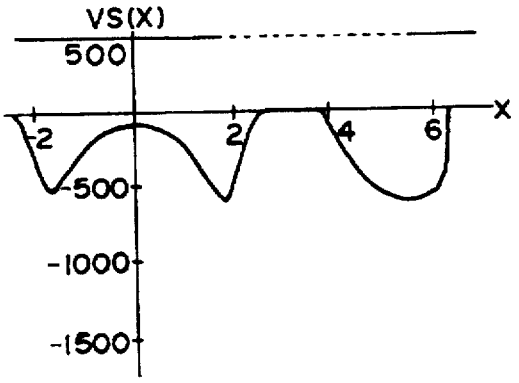
Figure 2B:
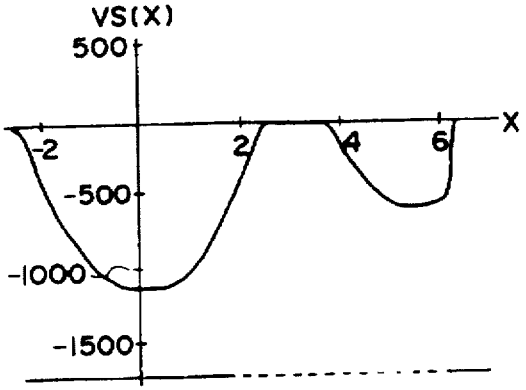
Figure 2E:
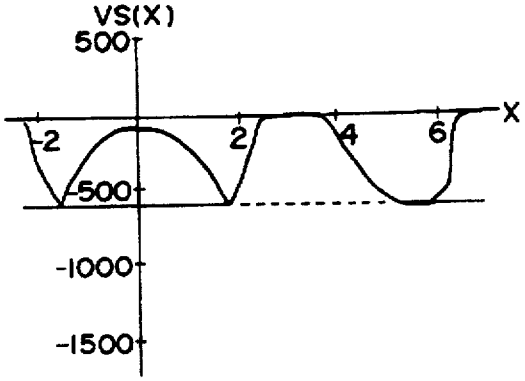
Figure 2C:
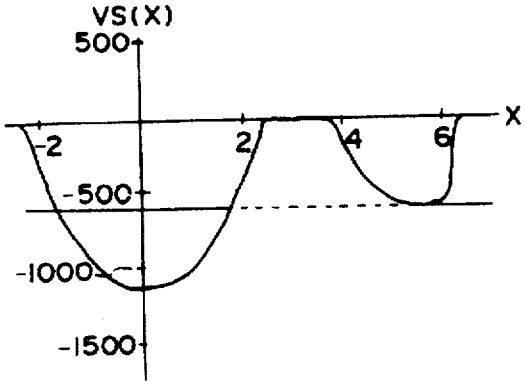
Figure 2F:
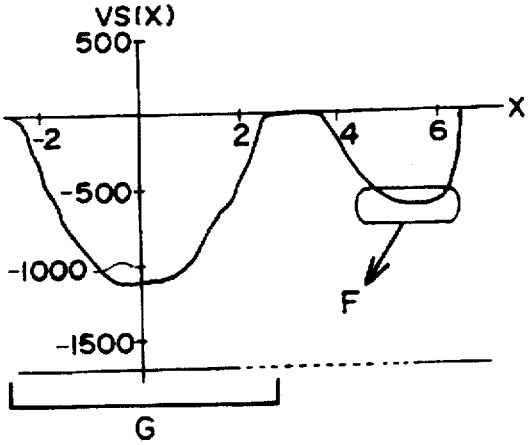

Referring to FIG. 1A, there are shown an image forming apparatus according to a first embodiment of the present invention, and FIG. 1B is a perspective view illustrating a positional relationship between the charging member and the photosensitive drum.

The image forming apparatus in this embodiment is in the form of a laser beam printer of an electrophotographic type using a contact charging device as a charging means for charging an image bearing member thereof.

An electrophotographic photosensitive member (photosensitive drum) 1 in the form of a rotatable drum as the image bearing member comprises a drum base 1*b* of aluminum and an organic photoconductor (OPC) layer 1*a* as a photosensitive layer. It has an outer diameter of 30 mm, and is rotated in the clockwise direction (arrow A) at a predetermined process speed Vps (peripheral speed).

A charging member 2 comprises an electrode plate of metal, electroconductive plastic resin material, electroconductive rubber or the like. A charging surface 2*a* thereof is faced to the surface of the photosensitive drum 1, by a spacer 14, by approx. 50 μm in the upstream side and by approx. 300 μm in the downstream side. As shown in FIG. 1B, the charging member 2 is contacted to the photosensitive drum 1 at three points, i.e., two points in the upstream side and one point at the downstream side.

Designated by a reference numeral 4 is a voltage application source for the charging member 20. The voltage source 40 supplies the charging member 2 with an oscillating voltage (Vac+Vdc) having a DC component Vdc and an AC component Vac having a peak-to-peak voltage Vpp which is larger than twice a charge starting voltage for the photosensitive drum 1. By doing so, the outer peripheral surface of the photosensitive drum, 1 which is being rotated, is uniformly contact-charged through an AC process. The oscillating voltage is a voltage having a voltage level which periodically changes with time.

On the other hand, a time series electric digital pixel signal representative of image (print) information is supplied to a laser scanner (not shown) from an unshown host apparatus such as a computer, a word processor, an image reader, or the like. A laser beam 5 which is imagewisely modulated with a predetermined print density (Ddpi) is produced. It scans the surface of the photosensitive drum 1 which has been charged and which is rotating, along a line (main scan direction which is parallel with a generating line of the photosensitive drum), by which the image information is written in, and an electrostatic latent image representative of the image information is formed on the surface of the rotating photosensitive drum 1.

The latent image is visualized into a toner image through a reverse development by a developing sleeve 6 of the developing device. The toner image is continuously transferred onto a transfer material 7, which has been fed at a predetermined timing, to a nip (transfer nip) formed between the photosensitive drum 1 and the transfer roller 8 from an unshown feeding station.

The transfer material 7 now having the toner image is fed to an image fixing means (not shown) after being separated from the surface of the photosensitive drum 1. Then, it is discharged as a print after the toner image is fixed. The surface of the rotating photosensitive drum 1 after the transfer material is separated therefrom, is cleaned by a cleaning blade 9 of the cleaner so that the residual matter such as toner is removed to be repeatedly used.

Figure 7:
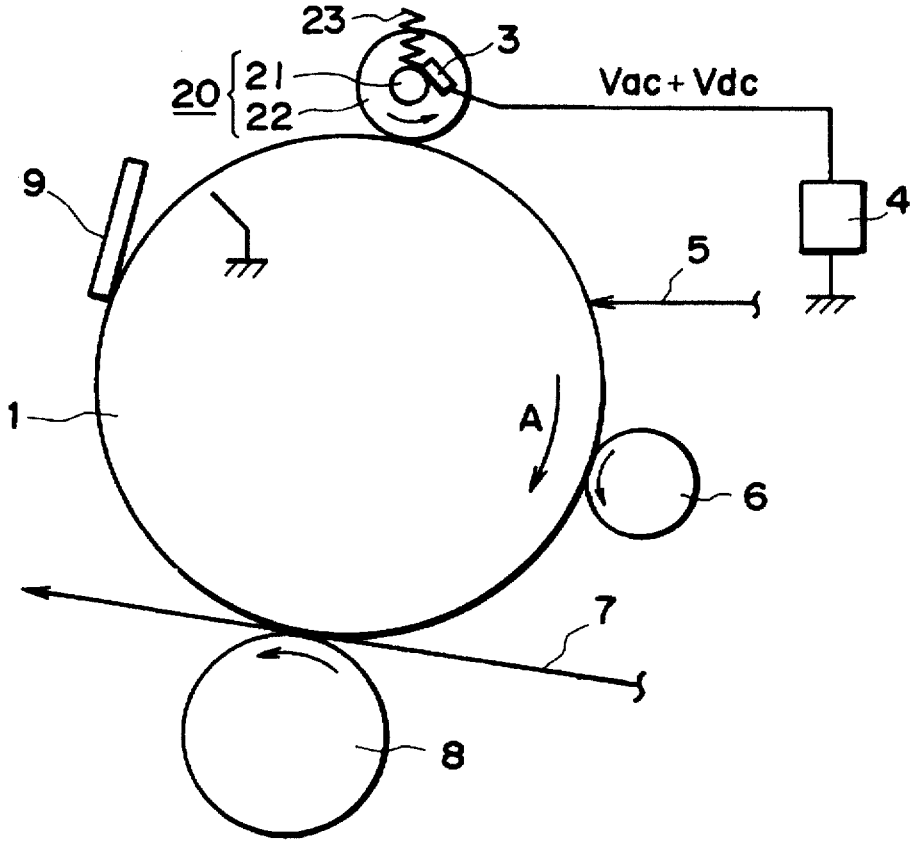
FIG. 7 illustrates an image forming apparatus using a charging roller (charging member).

FIG. 7 shows an example which uses a charging roller 20 as the charging member.

The charging member 20 is in the form of a charging roller (electroconductive roller), comprising a core metal rod 21 and an electroconductive member 22 of electroconductive rubber or the like on the periphery thereof. The charging roller 20 is press-contacted to the surface of the photosensitive drum 1 by a predetermined force provided by a compression spring 23 provided at each ends of the core metal rod 21. In this case, the charging roller 20 is driven by rotation of the photosensitive drum 1.

The charging roller 20 is supplied with an oscillating voltage (Vac+Vdc) by way of a contact leaf spring 3 contacted to the core metal 21 of the charging roller 20 from the voltage source 4.

When use is made with a charging roller 20 contacted to the member to be charged as shown in FIG. 7, the following problem arises.

For example, when a horizontal stripe pattern is outputted, interference fringes (moire) appear on the image when the intervals of the stripe pattern approaches to a cycle non-uniformity of the surface potential of the photosensitive drum determined by the frequency of the AC component of the voltage source applied to the contact charging member such as the charging roller.

An AC component frequency of the voltage source involves variation of ±10% because of manufacturing tolerance. Therefore, some of the voltage sources may have the frequency close to the spatial frequency of the horizontal line with the result of significant interference fringes.

A proposal has been made in an application assigned to the assignee of this application that the AC component frequency of the voltage source applied to the charging member is increased in accordance with the process speed as a major deterrent against the formation of any interference fringe. However, with the increase of the speed of the image formation, the process speed is required to be increased. Then, the so-called charging noise resulting from the primary voltage source frequency is increased with the increase of the primary frequency.

A. Causes of the Cycle Non-uniformity:

When the contact charging member is used, a cycle non-uniformity attributable to the primary voltage source frequency which is a cause of the interference fringe, occurs. Here, the description will be made as to the causes of the cycle non-uniformity.

Figure 8:
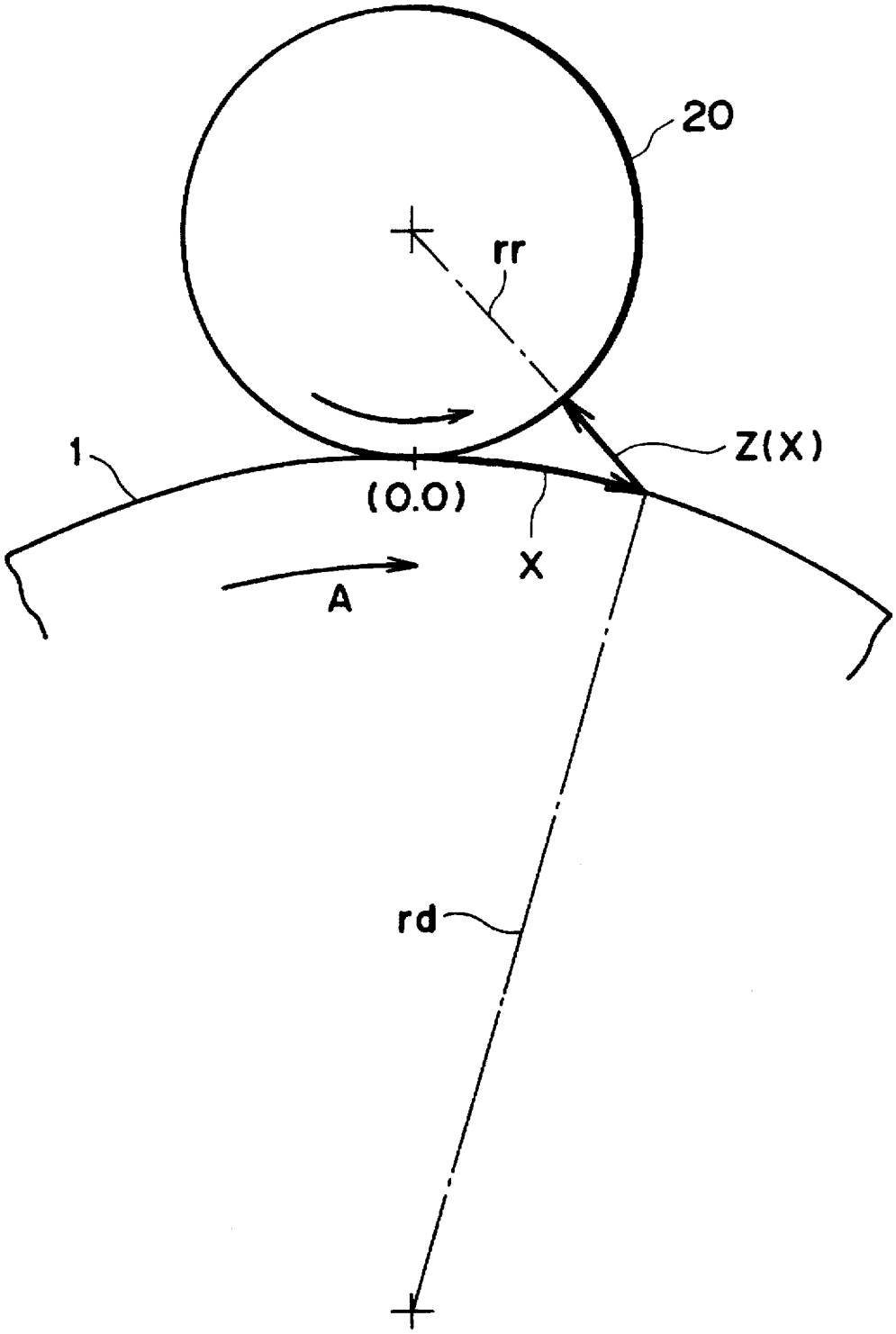
FIG. 8 illustrates a relationship between x and z[x] in the case that the charging member is in the form of a charging roller.
Figure 9A:
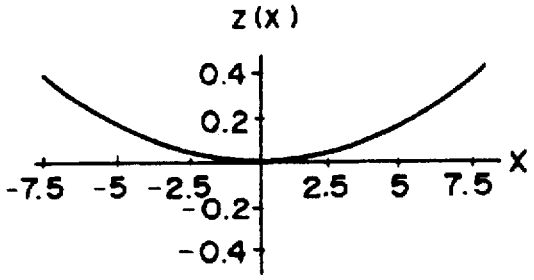
FIGS. 9(*a*) through 9(*h*) are graphs illustrating relationships among various factors.
Figure 9B:
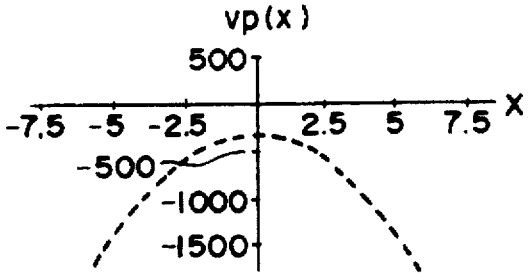
Figure 9C:
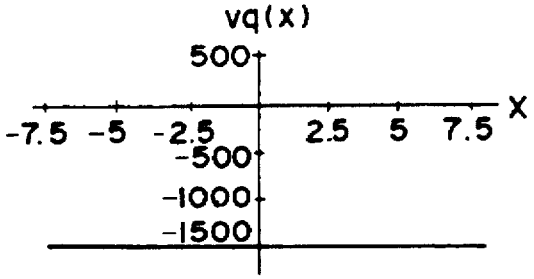
Figure 9D:
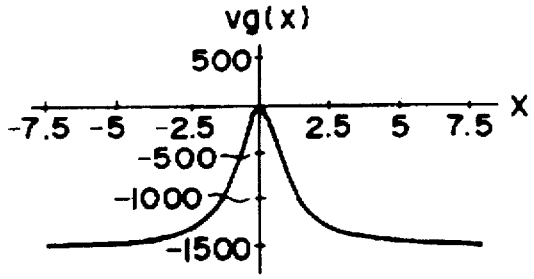
Figure 9E:
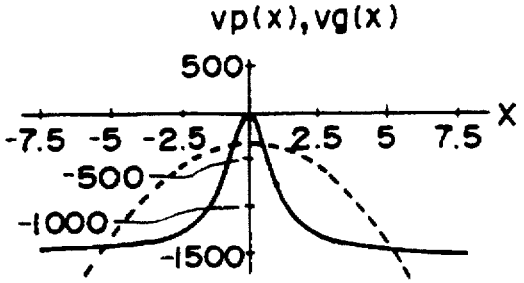
Figure 9F:
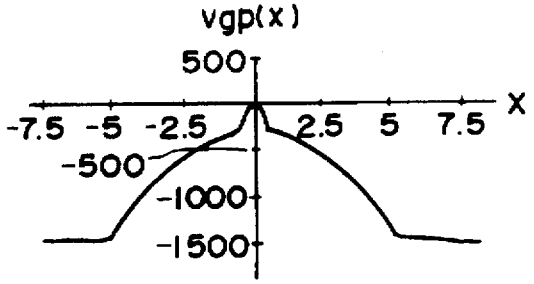
Figure 9G:
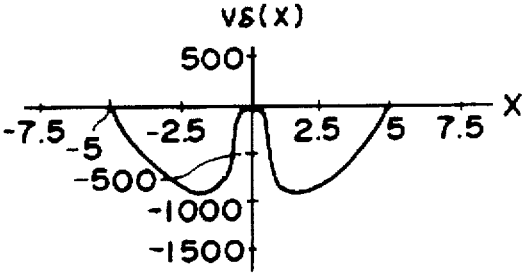
Figure 9H:
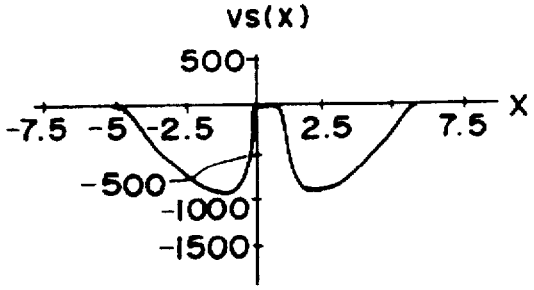
Figure 10A:
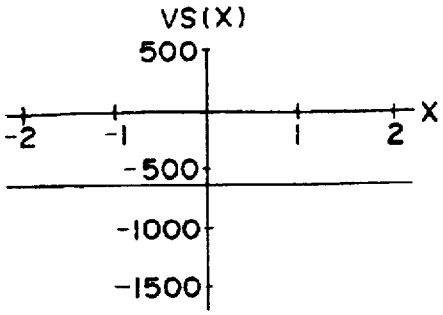
Figure 10E:
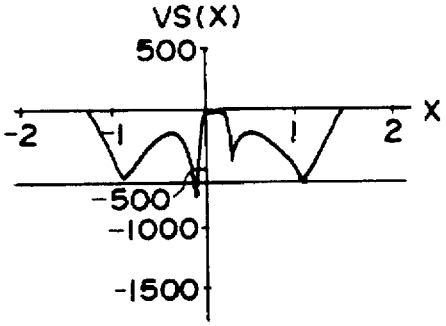
Figure 10B:
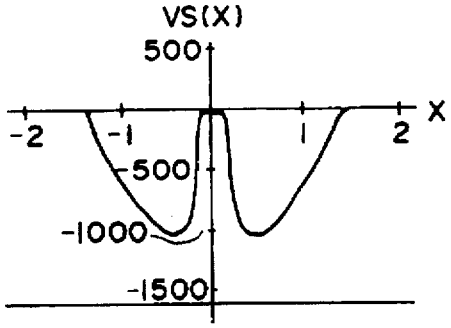
Figure 10F:
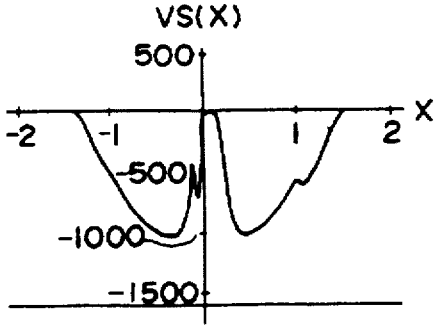
Figure 10C:
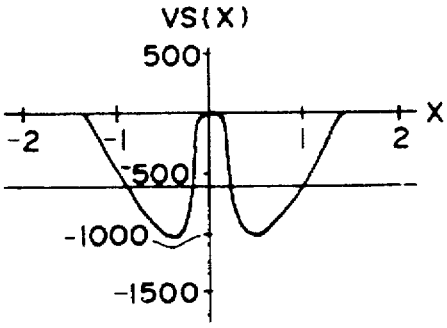
Figure 10G:
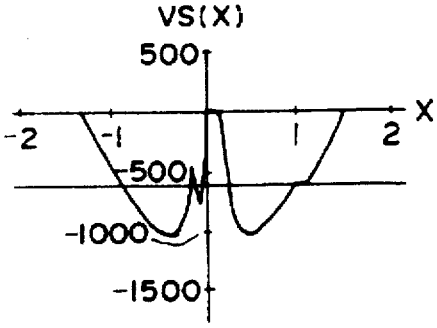
Figure 10D:
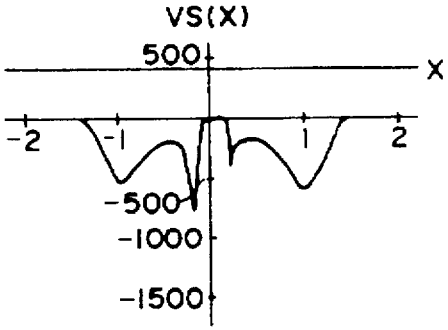
Figure 10H:
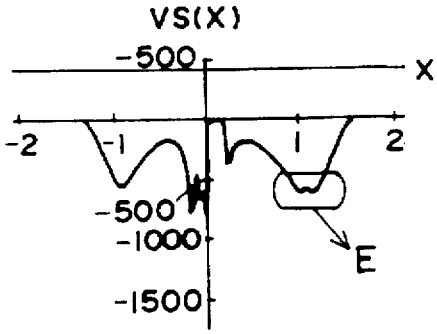

(1) A gap distance [z (x)] and position [x] on the drum:

As shown in FIG. 8, it is assumed that the position of the photosensitive drum closest to the charging roller 20 is (0, 0), and a minimum distance between a point on the photosensitive drum 1. 1 mm away from said point and the surface of the charging roller 20, is z[x].

Therefore, the distance z[x] of the point x on the photosensitive drum is a distance between a position x and an intersection of a line passing through the center of the charging roller 20 with the charging roller 20.

It is further assumed that a radius of the photosensitive drum 1 is rd, and a radius of the charging roller 20 is rr. The relationship is shown in (1) in the graph of FIG. 9, wherein the ordinate represents z[x], and the abscissa represents x.

$$z[x]=\{rd\times exp(xi/rd)-(rd+rr)\}-rr \quad (1)$$

(2) Corrected Paschen's curve [vp(x)]

FIG. 9 (2) is a graph of a corrected Paschen's charge at a point x on the photosensitive drum 1, wherein the ordinate represents a charge starting voltage Vp(x), and the abscissa represents x.

$$vp(x)=312+6200z(x) \quad (2)$$

(3) Applied voltage [Vq(t, n)]

The consideration will be made as to the case in which a pulse-like bias voltage of −1500 v is applied to the charging member 20.

In FIG. 9 (3), the ordinate represents the applied voltage Vq(t, n)=−1500 v, and the abscissa represents x.

(4) Gap voltage [vg(x, n)]

The voltage [vg(x, n)] across the gap between the charging member 20 and the photosensitive drum 1 at a point x is expressed as follows:

$$vg(x, n)=\{vq(t, n)-vs(x-vsp\times t, n-1))\}/\{L/(ez(x))+1)\} \quad (3)$$

Vps: process speed

L: thickness of the photosensitive layer e: specific dielectric constant n: number of samplings In vs(x−vsp×t, n−1), the surface potential of the photosensitive drum is 0 at vs=0, that is, at the initial stage, when n=1. The relationship is shown in graph (4) in FIG. 9, wherein the ordinate represents the gap voltage [vg(x)], and the abscissa represents x.

(5) Gap voltage after discharge [vgp(x, n)]

A graph (5) in FIG. 9 represents overlaid gap voltage. [vg(x, n)] and the corrected Paschen's curve [vp(x)] (broken line), wherein the ordinate represents vp(x)/vg(x, n), and the abscissa represents x.

In graph (5), when the absolute value of the gap voltage [vg(x, n)] is larger than the absolute value of the corrected Paschen's curve the discharge occurs in this position. Then, the gap voltage [vg(x, n)] decreases to the voltage of the corrected Paschen's curve [vp(x)].

This is called after-charge-gap-voltage [vgp(x, n)], and is shown in graph (6) of FIG. 9, wherein the ordinate represent vgp(x, n), and the abscissa represents x.

The above descriptions are summarized as equations (4)–(6), as follows.

$$1)\ \{vg(x, n)|\leqq vp8x)\rightarrow vgp(x, n)=vg(x, n) \quad (4)$$

$$2)\ vg(x, n)>0\rightarrow vgp(x, n)=vp(x) \quad (5)$$

$$3)\ vg(x, n)\leqq 0vg(x, n)<-vp(x)\rightarrow vgp(x, n)=vp(x) \quad (6)$$

(6) The surface potential of the photosensitive drum [vs(x, n)]

When the after-discharge-gap-voltage [vgp(x, n)] is determined, the surface potential on the photosensitive drum [vs(x, n)] is determined, using the gap voltage [vg(x, n)].

$$vs(x, n)=vg(t, n)-vgp(x, n)/\{1/(L/ez(x)+1)\} \quad (7)$$

The surface potential of the photosensitive drum [vs(x, n)] is shown in graph (7) in FIG. 9, wherein the ordinate represents vs(x, n), and the abscissa represents x.

(7) The surface potential on the photosensitive drum after t sec [vs(x−vsp x t, n)]

The surface potential on the photosensitive drum after t sec shifts toward light in the graph by the rotation of the photosensitive drum. The surface potential on the photosensitive drum, $$[vs(x-vsp\ x\ t, n)]$$

is shown in graph (8) of FIG. 9, wherein the ordinate represent vs(x−vsp×t, n), and the abscissa represents x. The movement distance in the direction x is vps×t.

(8) The case of AC current [vq(t, n)]

The AC bias voltage applied to the charging member is expressed as follows]

$$vq(t, n)=\tfrac{1}{2}\times vpp\ \sin\ (2\pi ft(n-1))+dc \quad (8)$$

vpp: peak-to-peak voltage of the applied bias voltage f: frequency of the applied bias voltage t: (¼)f (a quarter period)

n: number of samplings dc: DC component

In FIG. 10, graph (1) represents the case of vpp=200 v, f=350 Hz, n=1, and dc=−600 V.

If the applied voltage is substituted by the pulse bias voltage for every (¼)f, because the frequency of the primary bias voltage is sufficiently high relative to the process speed, and therefore, the change in the surface potential of the photosensitive drum can be sufficiently followed. In this graph, the ordinate represents the applied voltage, and the abscissa represents x.

(9) Results of simulation in n=8

In FIG. 10, graphs (1)–(8) are results of simulation of the surface potential [vs(x, n)] on the photosensitive drum when n is changed from 1 to 8.

The ordinate represent the surface potential [vs(x, n)] of the photosensitive drum, and the abscissa represents x.

Graph (1):

When n=1, the voltage applied to the photosensitive drum 1 surface from the charging member 20 is −600 V, and therefore, the surface of the photosensitive drum is charged only to the surface potential of several tens volt.

Graph (2):

When n=2, the applied voltage becomes −1600 V after t sec, and a wide area of the photosensitive drum is charged.

Graph (3):

When n=3, the applied voltage returns to −600 V after t sec. At this time, the gap voltage determined by the applied voltage and the drum surface potential does not exceed the charge starting voltage, and therefore, the surface potential on the photosensitive drum does not change, but it simply moves to the light at the process speed.

Graph (4):

When n=4, the applied voltage becomes +400 V after t sec. At this time, the gap voltage determined by the applied voltage and the drum surface potential exceeds partly the charge starting voltage. As a result, the surface potential of the photosensitive drum changes, and it moves to the light at the process speed.

Graph (5):

When n=5, the applied voltage returns to −600 V after t sec. At this time, the gap voltage determined by the applied voltage and the drum surface potential does not exceed The charge starting voltage at any portion. Therefore, the surface potential of the photosensitive drum does not change, but it simply moves to the light at the process speed.

Graph (6):

When n=6, the applied voltage becomes −1600 V after t sec. At this time, the gap voltage determined by the applied voltage and the drum surface potential partly exceeds the charge starting voltage. As the result, the surface potential of the photosensitive drum changes, and it further moves to the light at the process speed.

Graph (7):

When n=7, the applied voltage returns to −600 V after t sec. At this time, the gap voltage determined by the applied voltage and the drum surface potential does not exceed the charge starting voltage at any portion. Therefore, the surface potential of the photosensitive drum does not change, and it simply moves to the light at the process speed.

Graph (8):

When n=8, the applied voltage becomes +400 V after t sec. At this time, the gap voltage determined by the applied voltage and the drum surface potential partly exceeds the charge starting voltage. As a result, the surface potential of the photosensitive drum changes, and it moves to the light at the process speed.

Figure 11:
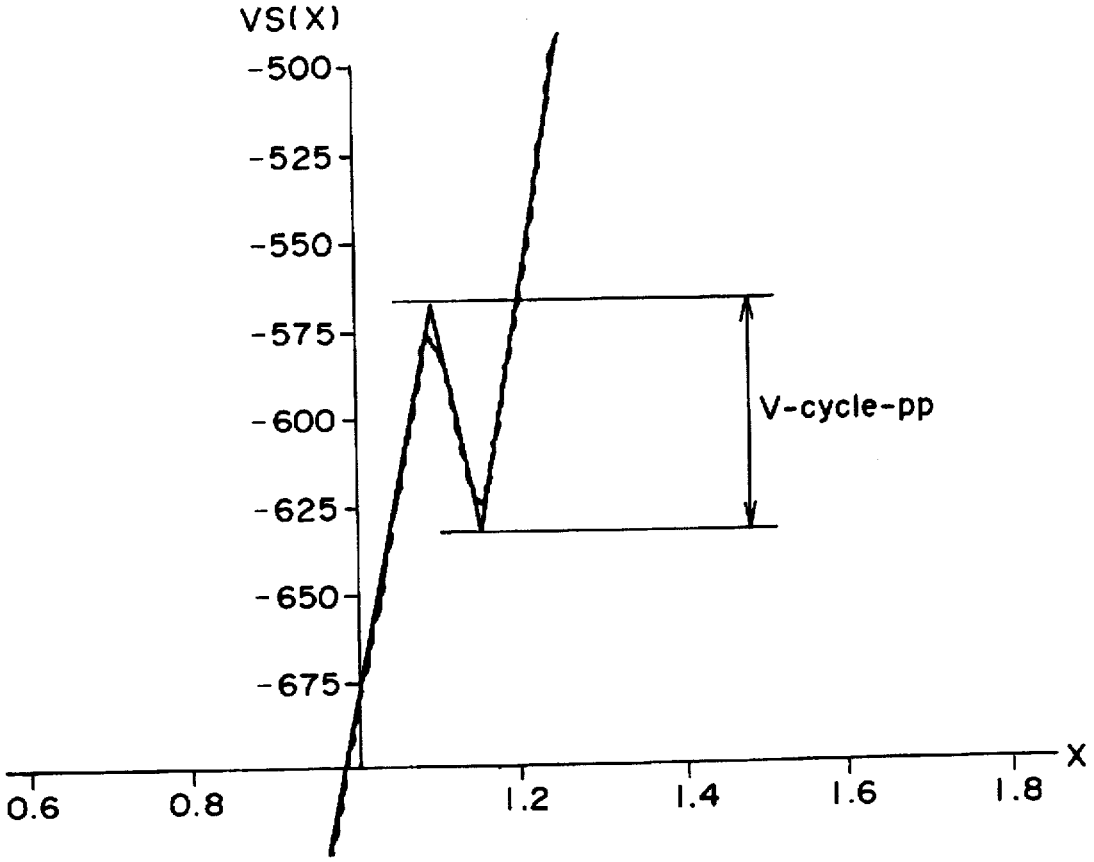
FIG. 11 is an enlarged graph of a portion E in graph (8) in FIG. 10.

In graph (8), the portion E is the peak-to-peak voltage of the cycle non-uniformity. The portion is enlarged and shown in FIG. 11.

The ordinate represents the surface potential of the photosensitive drum vs[x], and the abscissa represents x.

In the prior art example, the peak-to-peak voltage (V-cycle-pp) was approx. 77 V.

When the process speed is low or when the frequency of the primary voltage source is relatively low, the pitch of charging and discharging of the surface of the photosensitive drum by the charging member increases with the result that the peak-to-peak of the cyclic non-uniformity is increased, and therefore, the cycle non-uniformity becomes remarkable.

B. Cause of Interference Fringes:

As contrasted to the corona discharge, the contact charging is such that the charging distance between the photosensitive drum 1 and the charging roller 20 is very small, and therefore, it is easily influenced by variation of the voltage source 4. Therefore, it involves the problem of the charge non-uniformity called cycle non-uniformity having a spatial frequency of λsp (=Vp/f) determined by the frequency f of the oscillating voltage component of the applied voltage source 4 and the process speed Vp.

Additionally, in long term operation, toner, silica, paper dust or the like is deposited on the surface of the charging roller 20 with the result that the deposited portion acquires additional electrostatic capacity. Therefore, even if the same voltage is applied to the core metal rod 21 of the charging roller 20, the surface potential induced on the photosensitive drum 1 is different in phase between the additional electrostatic capacity portion and the portion without it.

As described in the foregoing, despite the same pitch lines are printed on one print, the portions clearly developed and the portions not clearly developed, are mixed, with the result of conspicuous interference fringe.

The point of start of occurrence of the interference fringe is determined by the following equation, and on the basis of the equation, the proper frequency is selected so as to avoid the interference fringe. When it is assumed that a line width of the line scan is n, and a sum of a line and a line interval m is N (a number of one period dots of a plurality of lines, that is, N times (=n+m) of the minimum line pitch), and the primary frequency is f:

$$f=Vp/(25.4/D\times N/M) \tag{10}$$

The oscillating voltage component (AC component) of the voltage source 4 may produce a sine wave, triangular wave, or a rectangular wave provided by switching a DC voltage, or the like.

However, in the case of high speed machine having a high process speed is required to use a primary voltage source frequency, which is high, in order to avoid the interference fringe. With the increase, the problem of charging noise occurs. The charging noise can be reduced by inserting a vibration suppressing member inside the photosensitive drum. On the other hand, the problems of deformation, weight increase, manufacturing cost increase, or the like of the photosensitive drum, arise.

In order to prevent the interference fringe, it is preferable that the charging surface of the charging member 2 is in the same area as the drum 1 surface, as defined by a boundary of a line S parallel to a drum tangent line at the most downstream point of the closest part of the charging member 2 to the drum 1 toward the downstream, with respect to the rotational direction of the drum 1. Using the structure of the charging member 2, the charging width can be increased as compared with the charging roller 20, and therefore, uniform charging is assured.

The charging member 2 assures the dischargeable region determined by the gap voltage [vg(x, n)] and the corrected Paschen's curve [vp(x)].

(1) Gap distance [z(x)] and position [x] on the drum

As shown in FIG. 1, (*a*), a point on the photosensitive drum at the closest point between the photosensitive drum 1 and the charging member 2 is (0, 0), and the minimum distance between a point×mm downstream thereof on the photosensitive drum and the surface of the charging member 2 is [x(z)].

(2) Corrected Paschen's curve [vp(x)]

The following equation (12) is a corrected Paschen's curve at a point x on the photosensitive drum 1.

$$vp(x)=312+6200z(x) \tag{12}$$

(3) AC voltage [vq(t, n)] applied

The AC bias voltage applied to the charging member is expressed as follows:

$$vq(t, n)=½\times vpp \sin(2\pi ft(n-1))+dc \tag{13}$$

vpp: peak-to-peak voltage of the applied bias voltage f: frequency of the applied bias voltage t: (¼)f (a quarter period)

n: number of samplings dc: DC component

Vpp=2200 v, f=350 Hz, n=1, dc=−600 V.

The applied bias voltage is substituted by pulse bias voltage for every (¼)f, because the primary bias voltage frequency is sufficiently high relative to the process speed, and therefore, it can sufficiently follow the change in the surface potential of the photosensitive drum.

(4) Gap voltage [vg(x, n)]

The gap voltage relative to the charging member 2 at a point x on the photosensitive drum 1 [vg(x)] is expressed as follows:

$$vg(x, n)=\{vq(t, n)-vs(x-vps\times t, n-1)\}/\{L/(ez(x))+1\} \tag{14}$$

vps: process speed

L: thickness of the photosensitive layer e: specific dielectric constant

In vs(x−vps×t, n−1), the surface potential of the photosensitive drum is 0 at vs=0, that is in the initial stage, when n=1.

(5) After-discharge-gap-voltage [vgp(x, n)]

When the absolute value of the gap voltage [vg(x, n)] is larger than the absolute value of the corrected Paschen's curve [vp(x)], the discharge occurs at such a position. Then, the gap voltage [vg(x, n)] decreases to the voltage of the corrected Paschen's curve [vp(x)]. This is called an after-discharge-gap-voltage [vgp(x, n)].

$$1)\ |vg(x, n)|\leq|vp(x)|\rightarrow vgp(x, n)=vg(x, n) \tag{15}$$

$$2)\ vg(x, n)>0\ vg(x, n)>vp(x)\rightarrow vgp(x, n)=vp(x) \tag{16}$$

$$3)\ vg(x, n)\leq 0\ vg(x, n)<-vp(x)\rightarrow vgp(x, n)=vp(x) \tag{17}$$

(6) surface potential of the photosensitive drum [vs(x, n)]

When the after-discharge-gap-voltage [vgp(x, n)] is determined, the surface potential [vs(x, n)] of the photosensitive drum is determined using the equation of the gap voltage [vg(x, n)], as follows:

$$vs(x, n)=vq(t, n)-vgp(x, n)/\{1/(L/ez(x)+1)\} \tag{18}$$

The surface potential [vs(x, n)] on the photosensitive drum shown in graph (1) of FIG. 2, wherein the ordinate represents vs(x, n), and the abscissa represents x.

(7) The surface potential [vs(x−vps×t, n)] of the photosensitive drum after t sec The surface potential on the photosensitive drum shift to the light in the graph by the rotation of the photosensitive drum after t sec. The surface potential [vs(x−vps×t, n)] of the photosensitive drum at this time is shown in graph (2) in FIG. 2. The movement distance in the x direction is vps×t.

Results of simulation will be described.

The results of simulation of the surface potential [vs(x, n)] on the photosensitive drum when n is changed from 1 to 6 is shown in graphs (1) to (6) in FIG. 2, wherein the ordinate represents the surface potential [vs(x, n)] on the photosensitive drum, and the abscissa represents x.

Graph (1):

When n=1, the voltage applied to the surface of the photosensitive drum from the charging member is −600 V, and therefore, the surface of the photosensitive drum is charged only to the surface potential of several tens volt.

Graph (2):

When n=2, the applied voltage becomes −1700 V after t sec, and a wide area of the photosensitive drum is charged.

Graph (3):

When n=3, the applied voltage returns to −600 V after t sec. At this time, the gap voltage determined by the applied voltage and the surface potential of the drum does not exceed at any portion the charge starting voltage. Therefore, the surface potential of the photosensitive drum does not change, but it simply shifts to the light at the process speed.

Graph (4):

When n=4, the applied voltage becomes +500 V after t sec. At this time, the gap voltage determined by the applied voltage and the drum surface potential partly exceeds the charge starting voltage. As a result, the surface potential on the photosensitive drum changes, and it moves to the light at the process speed.

Graph (5):

When n=5, the applied voltage returns −600 V after t sec. At this time, the gap voltage determined by the applied voltage and the drum surface potential does not exceed the charge starting voltage at any portion. Therefore, the surface potential on the photosensitive drum does not change, and it simply moves to the right at the process speed.

Graph (6):

When n=6, the applied voltage becomes −1700 V after t sec. At this time, the gap voltage determined by the applied voltage and the drum surface potential partly exceeds the charge starting voltage. As a result, the surface potential on the photosensitive drum changes, and it moves to the light at the process speed.

Figure 3:
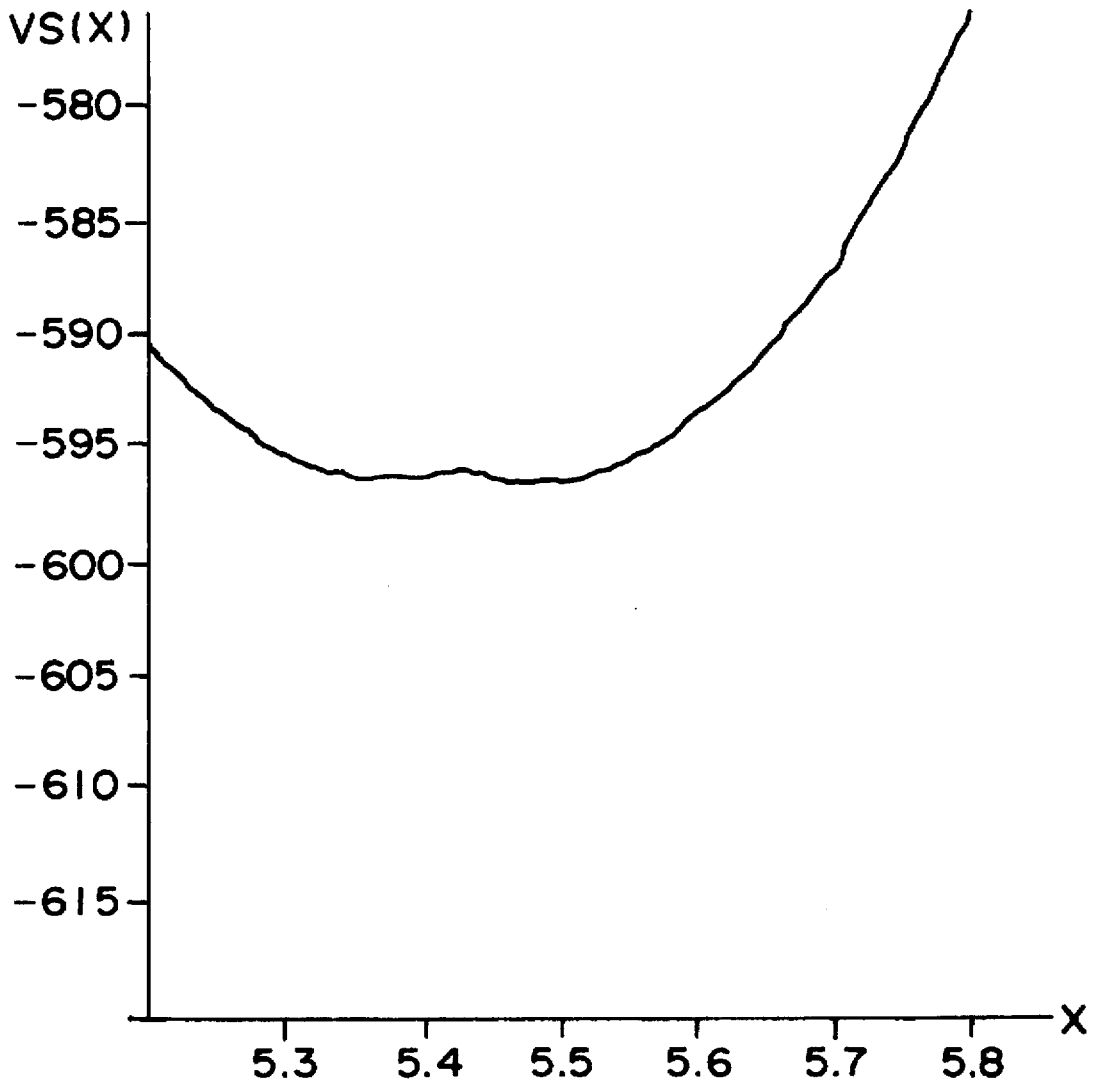
FIG. 3 is an enlarged graph of F portion in graph (6) in FIG. 3.

A portion indicated by F in graph (6), represents the peak-to-peak voltage of the cycle non-uniformity. This is enlarged and shown in FIG. 3, wherein the ordinate represents the surface potential of the photosensitive drum, and the abscissa represents x. As contrasted to the conventional example, the peak-to-peak voltage (V-cycle-pp) is substantially 0 in this embodiment.

In region G in graph (6), the surface potential of the photosensitive drum is repeatedly changed by charging and discharging by the charging member 2, and the uniform potential effect is provided as in the conventional example.

The images have been produced with the above-described system, and it has been confirmed that no cycle non-uniformity is observed even in halftone images, and that the images are satisfactory without photosensitive drum memory.

As described, there is provided a region in which a distance between the charging surface of the charging member and the surface of the member to be charged is smaller in the upstream portion than in the downstream portion in the direction of the surface movement of the member to be charged, and there is also provided a downstream portion in which the distance is substantially constant. By the provisions of the regions, the cycle non-uniformity can be suppressed, and the frequency of the applied voltage can be reduced. As a result, the levels of the interference fringe and the charging noise could be reduced to the levels of no problem.

In addition, the charging member is supported at three points in the non-image area, relative to the photosensitive drum. Therefore, the charging member is out of contact with the photosensitive drum in the image formation region in the drum generating line direction, so that the toner fusing onto the drum be suppressed in comparison with the contact charging such as a charging roller.

In order to uniformly charge the photosensitive drum, it is desirable that the distance between the charging member (charging plate) and the photosensitive drum in the upstream region is constant in the longitudinal direction. The supporting of the charging member at three points, i.e., two upstream point and one downstream point with respect to the drum rotational direction, and therefore, the positional accuracy is increased in the upstream side so that the small gap (discharge region) can be stably formed. One of the three points is located closer to the most upstream point than the most downstream point in the rotational direction of the drum.

The three point support is effective to provide the constant distance in the upstream region even when the maximum sheet passage width is large with the result of difficulty in the dimensional accuracy of the charging member.

In FIG. 1, (*b*), a fourth spacer 14' may be added. Even in this case, when the photosensitive drum 1 starts to rotate, it is substantially supported by the three points. Therefore, the same advantageous effects can be provided even if the fourth spacer 14' is provided.

In addition, that the peak-to-peak voltage of the cycle non-uniformity can be reduced, means that the frequency of the applied voltage can be reduced if the process speed is constant. Then, the charging noise can be reduced.

An apparatus of FIG. 1 in which the DC component frequency is reduced to 200 Hz from 350 Hz, is placed in an unechoic AC chamber, and the noise is measured in accordance with ISO 7779, paragraph 6. As a result, the noise is reduced to 33 dB from 55 dB of the conventional charging roller apparatus, and the interference fringe of the output image is not conspicuous.

The charging member of this embodiment is easy to mold as compared with the conventional charging roller or the like, and therefore, the cost can be decreased. Since it is out of contact with the photosensitive drum, and the wearing or deterioration can be reduced in a long term use, and therefore, it is advantageous from the standpoint of recycling the apparatus.

Figure 4:
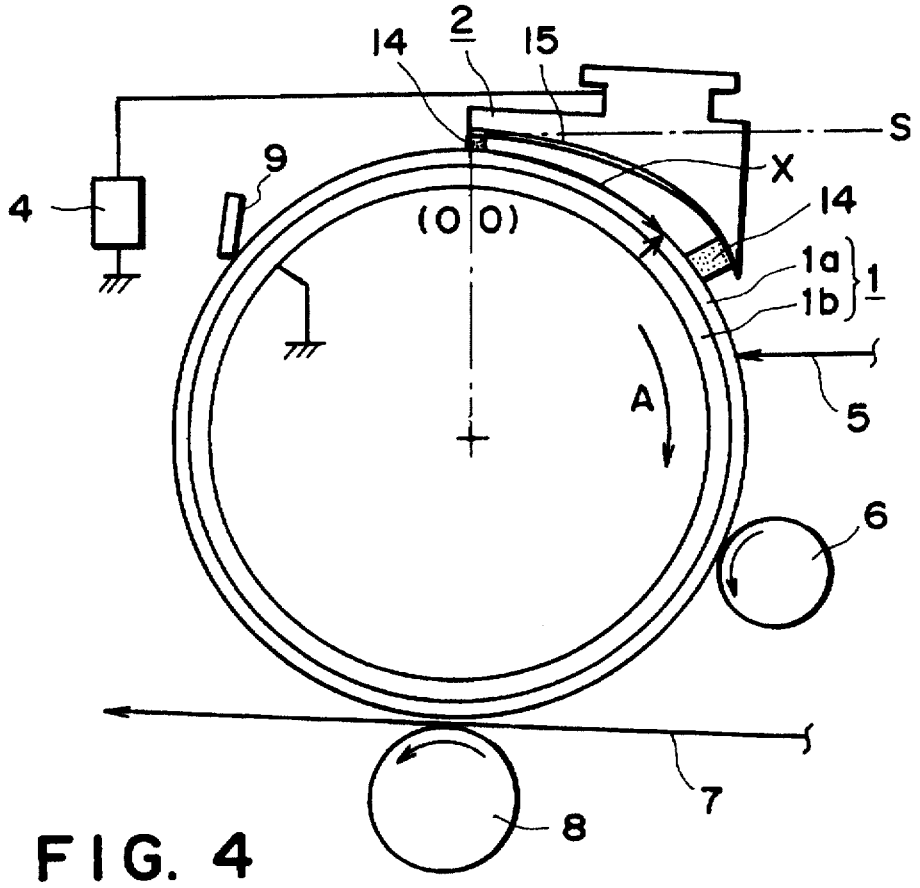
FIG. 4 illustrates a charging member according to a second embodiment of the present invention.

Embodiment 2 (FIG. 4)

Referring to FIG. 4, another embodiment of the charging member will be described. In this embodiment, the apparatus of the first embodiment (FIG. 1) is used, but the charging member 2 is coated with a thin surface protection layer 15 for the purpose of, for example, preventing abnormal discharge such as current leakage or the like, the charging member 2 at a defective portion such as a pin hole or the like which can exist in the surface of the image bearing member (photosensitive drum) as the member to he charged. The protection layer 15 may be of epichlorohydrin rubber, Toresin or the like having a high resistance.

Similarly to the first embodiment, the charging member 2 is supported at three points relative to the surface of the photosensitive drum 1. In the case of the charging member 2 of this structure, similar to the first embodiment, the cycle non-uniformity is reduced as compared with the case of the charging roller or the like, and therefore, the interference fringe becomes less remarkable, and therefore, the frequency can be reduced, and the charging noise can be reduced. Even if the photosensitive drum 1 has a defect such as a pin hole or the like, the leakage of the current can be prevented.

In the case of the position of the high resistance layer 15 on the surface of the charging member 2 as in this embodiment, it is desirable, similarly to the first embodiment that the distance between the charging member 2 and the photosensitive drum 1 in the upstream region with respect to the rotational direction of the drum, is uniform in the longitudinal direction. By the supporting at two points in the upstream side and at one point in the downstream side with the use of spacers 14 or the like, is effective to stabilize the surface potential of the photosensitive drum after the charging, and the cycle non-uniformity can be reduced.

Figure 5:
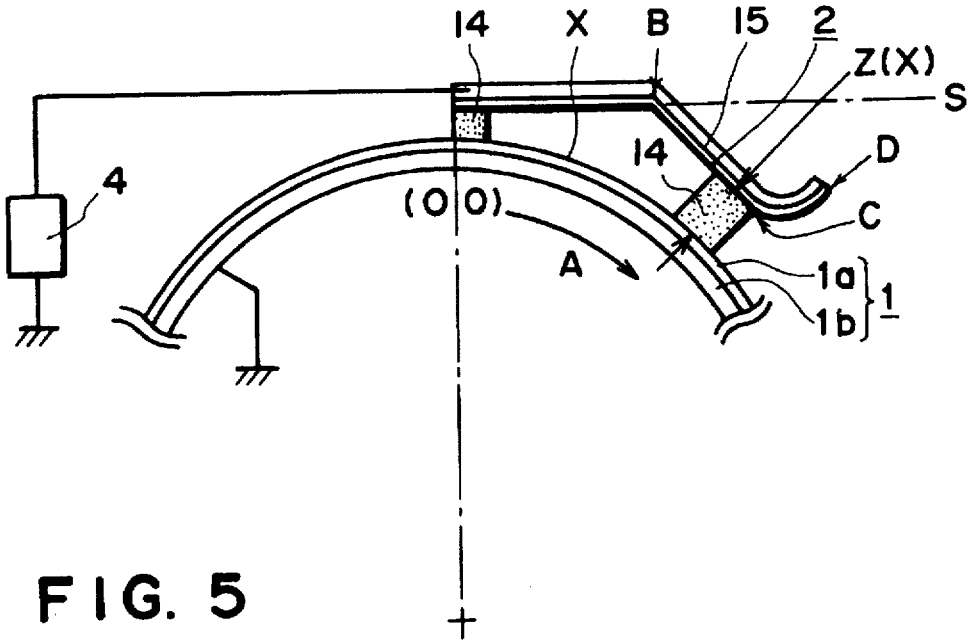
FIG. 5 illustrates a charging member according to a third embodiment of the present invention.

Embodiment 3 (FIG. 5)

Referring to FIG. 5, a further embodiment of the charging member will be described. In this embodiment, the charging member exists only in the downstream side of the closest point between the photosensitive drum 1 and the charging member 2. In this case, the charging member becomes very compact. An end of the charging member 2 is curved into a curvature having a radius of curvature R between points C and D. With this structure, the peak-to-peak voltage of the cycle non-uniformity on the photosensitive drum 1 is determined by the configuration between points B and C of the charging member 2 involved in the charging region, and therefore, the surface potential of the photosensitive drum with hardly conspicuous cyclic non-uniformity can be provided.

Similarly to the first embodiment, the charging member 2 is supported at two upstream points and one downstream point by spacer 14 with respect to the drum rotational direction to provide the constant distance from the surface of the photosensitive drum. By the three point support, the positional accuracy in the downstream portion can be increased, so that the stabilized charging is possible.

In the positional relation, in the longitudinal direction of the three spacers 14, if the arrangement is such that the upstream spacer is not overlapped with the downstream spacer, the wearing of the surface of the photosensitive drum can be reduced. This is effective to prevent non-uniform distance between the charging member and the photosensitive drum in the longitudinal direction as a result of more significant wearing at only one side of the drum.

Figure 6:
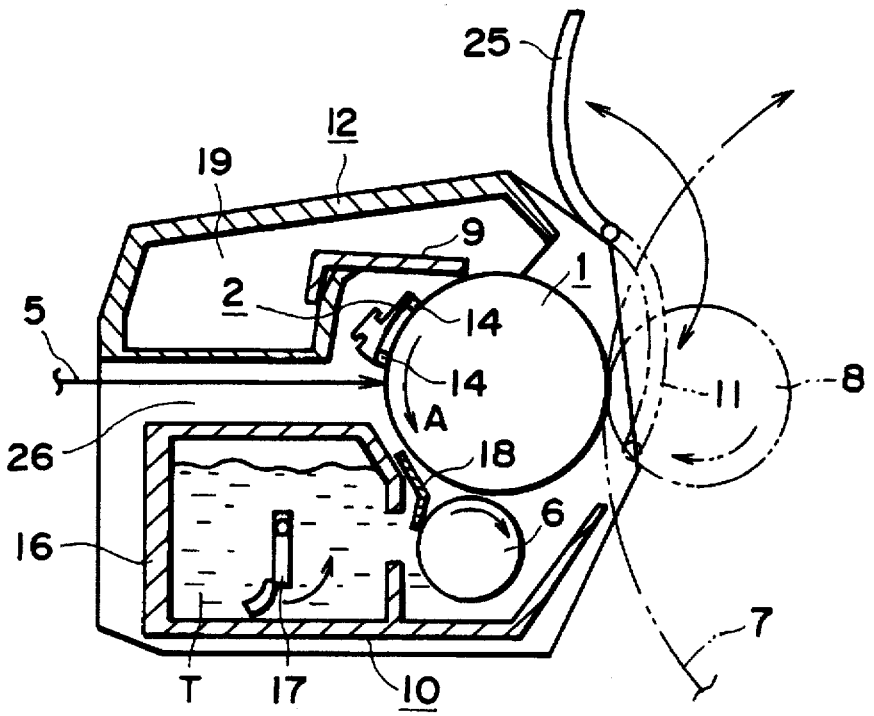
FIG. 6 illustrates a process cartridge.

FIG. 6 shows an example in which the charging device of FIG. 1 is used in a process cartridge. The process cartridge is detachably mountable to a main assembly of an image forming apparatus.

The process cartridge of this embodiment comprises four process means, i.e., an electrophotographic photosensitive member 1 in the form of a rotatable drum as an image bearing member, a charging plate 2 has the charging member, a developing device 10, and a cleaning device 14. However, the process cartridge is satisfactory if it contains at least a photosensitive member 1 and a charging plate 2. The voltage source 4 is provided in the main assembly of the image forming apparatus.

The charging member 2 has the same structure as shown in FIG. 1.

In the developing device 10, there are provided a developing sleeve 6, a toner container 16 for containing a developer (toner) T, a toner stirring member 17 in the container 16, which functions to stir the toner T and feed it toward the developing sleeve, and a developer blade 18 for applying the toner T on the sleeve 6 into a uniform thickness layer.

In the cleaning device 12, there are provided a cleaning blade 9, a toner container 19 for containing the toner removed by the cleaning blade 9.

A drum shutter 25 of the process cartridge is movable between an open position indicated by the solid lines and a closed position indicated by the chain lines. When the process cartridge is taken out of the main assembly (not shown), it is in the closed position indicated by the chain lines, so as to protect the surface of the photosensitive drum 1.

When the process cartridge is mounted in the main assembly of the image forming apparatus, the shutter 25 is opened to the position indicated by the solid lines. Or, it is automatically opened in the mounting process of the process cartridge. When the process cartridge is mounted in place in the main assembly, the exposed portion of the photosensitive drum 1 is press-contacted to the transfer roller 8 in the main assembly.

The mechanical and electric couplings are established between the process cartridge and the main assembly to permit driving of the photosensitive drum 1, the developing sleeve 6 end the stirring rod 17 or the like of the process cartridge by the driving mechanism of the main assembly, and in addition, applications of the charging voltage to the charging member 2 and the developing bias to the developing sleeve 6 are permitted from the electric circuit of the main assembly, so as to enable the image forming operation.

An exposure path 26 is formed between the cleaning device 12 and the developing device 10 of the process cartridge to permit an output laser beam 5 from an unshown laser scanner of the main assembly to scan the photosensitive drum 1 in the process cartridge therethrough.

With this structure, the peak-to-peak voltage of the cycle non-uniformity is very small, and therefore, the interference fringe is hardly remarkable in the print, by using the process cartridge of this embodiment.

The line scan is not limited to the longitudinal (generating line direction) scan of the image bearing member using polygonal mirror, with the laser beam, but includes an LED head having LED elements arranged in a longitudinal direction of the image bearing member, faced to the image bearing member, in which the LED elements are rendered on and off in accordance with a signal from a controller.

The image bearing member is not limited to the photosensitive drum, but may be an insulative member. In this case, a multi-stylus recording head may be used, which comprises pin electrodes opposed to the image bearing member disposed downstream of the charging member with respect to the rotational direction of the image bearing member, and the latent image is formed after the charging. The image forming apparatus may use a regular development and a reverse development.

In order to prevent the spot-like non-uniformity on the member to be charged, the oscillating voltage applied to the charging member desirably has a peak-to-peak voltage which is not less than twice the charge starting voltage. The charge starting voltage is a DC voltage at which the charging of the member to be charged starts when only a DC voltage is applied between the charging member and the member to be charged.

As for the waveform of the oscillating voltage, a sine, rectangular, triangular or the like, waves are usable. The oscillating voltage may be provided by periodically rendering on and off a DC voltage source (pulse wave) into a DC biased AC voltage.

The distance between the charging surface of the charging member and the member to be charged is preferably 5–1000 μm.

While the invention has been described with reference to the structures disclosed herein, it is not confined to the details set forth and this application is intended to cover such modifications or changes as may come within the purposes of the improvement or the scope of the following claims.

What is claimed is:

1. An image forming apparatus comprising:

a movable member to be charged, which is capable of bearing an image;

a charging member for charging said member to be charged, wherein a voltage is applied between said charging member and said member to be charged;

means contacted to said member to be charged at least at three different positions of said member to be charged so that a gap is formed between said charging member and said member to be charged, wherein first and second positions of the different positions are different in a direction of a generating line of said member to be charged, and the first position and a third position of the different positions are different in a movement direction of said member to be charged.

2. An apparatus according to claim 1, wherein a distance of the gap between said charging member and said member to be charged is smaller in an upstream region than in a most downstream region.

3. An apparatus according to claim 2, wherein the distance of the gap between said charging member and said member to be charged is substantially constant in the most downstream region.

4. An apparatus according to claim 1 or 2, wherein two of the three positions are substantially at the same first position in a movement direction of said member to be charged, and the other position is downstream of the first position in the movement direction of said member to be charged.

5. An apparatus according to claim 1, wherein one of the at least three positions is closer to a most upstream one of the positions than a most downstream one of the positions with respect to a movement direction of said member to be charged.

6. An apparatus according to claim 2, wherein a closest position between said charging member and said member to be charged is in the most downstream position.

7. An apparatus according to claim 1 or 2, wherein a charging surface of said charging member is in a same region as said member to be charged with respect to a line parallel to a tangent line of said member to be charged at a most downstream point in a closest region between said charging surface and said member to be charged.

8. An apparatus according to claim 1 or 2, wherein the voltage is an oscillating voltage.

9. An apparatus according to claim 8, wherein the oscillating voltage has a peak-to-peak voltage which is not less than twice a DC voltage at which charging of said charging member starts when a DC voltage is applied between said charging member and said member to be charged.

10. An apparatus according to claim 1, wherein an image is formed on said member to be charged using charging of said charging member.

11. An apparatus according to claim 10, wherein said member to be charged is charged by said charging member, and thereafter, an electrostatic latent image is formed on said member to be charged along a scanning line.

12. An apparatus according to claim 1, wherein a distance between said charging member and said member to be charged is 5–1000 μm.

13. An apparatus according to claim 1, wherein said charging member has a concave charging surface.

14. An apparatus according to claim 1, wherein all of the different positions are outside an image bearing area of said member to be charged.

15. A process cartridge detachably mountable to a main assembly of an image forming apparatus, comprising:

a movable member to be charged, for bearing an image;

a charging member for charging said member to be charged, wherein a voltage is applied between said charging member and said member to be charged; and means contacted to said member to be charged at least at three different positions of said member to be charged so that a gap is formed between said charging member and said member to be charged, wherein first and second positions of said different positions are different in a direction of a generating line of said member to be charged, and the first position and a third position of the different positions are different in a movement direction of said member to be charged.

16. A process cartridge according to claim 15, wherein a distance between said charging member and said member to be charged is smaller in an upstream region than in a most downstream region.

17. A process cartridge according to claim 15, wherein the distance is substantially constant in the most downstream region.

18. A process cartridge according to claim 14 or 15, wherein two of the three positions are substantially at the same first position in a movement direction of said member to be charged, and the other position is downstream of the first position in the movement direction of said member to be charged.

19. A process cartridge according to claim 14 or 15, wherein said charging member has a charging surface, wherein said charging surface is in a same region as said member to be charged with respect to a line parallel to a tangent line of said member to be charged at a most downstream point in a closest region between said charging surface and said member to be charged.

20. An apparatus according to claim 14, wherein an oscillating voltage is applied from a voltage source of the main assembly between said charging member and said member to be charged.

21. An apparatus according to claim 14, wherein a distance between said charging member and said member to be charged is 5–1000 μm.

22. A process cartridge according to claim 14, wherein said charging member has a concave charging surface.

23. A process cartridge according to claim 15, wherein all of said different positions are outside an image bearing area of said member to be charged.

* * * * *

UNITED STATES PATENT AND TRADEMARK OFFICE

CERTIFICATE OF CORRECTION

PATENT NO. : 5,678,141

DATED : October 14, 1997

INVENTOR(S) : ERIKA ASANO, ET AL.

It is certified that error appears in the above-identified patent and that said Letters Patent is hereby corrected as shown below:

COLUMN 2:

Line 28, "FIGS. 2(a) through 2(f)" should read --FIGS. 2A through 2F--.
Line 43, "FIGS. 9(a) through 9(h)" should read --FIGS. 9A through 9H--.
Line 45, "FIGS. 1(a) through 10(h)" should read --FIGS. 10A through 10H--.

COLUMN 3:

Line 61, "ends" should read --end--.

COLUMN 4:

Line 45, "(1)" should read --A--.
Line 51, "FIG. 9(2)" should read --FIG. 9B--.
Line 61, "FIG. 9(3)" should read --FIG. 9C--.

COLUMN 5:

Line 13, "(5)" should read --E--.
Line 17, "(5)" should read --9E--.
Line 23, "(6)" should read --F--.
Line 41, "(7)" should read --G--.
Line 51, "(8)" should read --H--.
Line 66, "(1)" should read --A--.

COLUMN 6:

Line 9, "(1)-(8)" should read --A-H--.
Line 14, "(1)" should read --10A--.

UNITED STATES PATENT AND TRADEMARK OFFICE

CERTIFICATE OF CORRECTION

PATENT NO. : 5,678,141

DATED : October 14, 1997

INVENTOR(S) : ERIKA ASANO, ET AL.

It is certified that error appears in the above-identified patent and that said Letters Patent is hereby corrected as shown below:

COLUMN 6 (Continued)

Line 18, "(2)" should read --10B--.
Line 21, "(3)" should read --10C--.
Line 28, "(4)" should read --10D--.
Line 35, "(5)" should read --10E--.
Line 38, "The" should read --the--.
Line 42, "(6)" should read --10F--.
Line 49, "(7)" should read --10G--.
Line 56, "(8)" should read --10H--.
Line 63, "graph (8)" should read --graph 10H--.

COLUMN 8:

Line 2, "Fig. 1, (a)," should read --Fig. 1A--.
Line 66, "graph (1)" should read --graph A--.

COLUMN 9:

Line 6, "graph (2)" should read --graph B--.
Line 11, "(1) to (6)" should read --A-F--.
Line 14, "(1)" should read --2A--.
Line 19, "(2)" should read --2B--.
Line 22, "(3)" should read --2C--.
Line 29, "(4)" should read --2D--.
Line 36, "(5)" should read --2E--.
Line 43, "(6)" should read --2F--.
Line 50, "(6)" should read --2F--.
Line 57, "(6)" should read --2F--.

UNITED STATES PATENT AND TRADEMARK OFFICE

CERTIFICATE OF CORRECTION

PATENT NO. : 5,678,141 Page 3 of 3

DATED : October 14, 1997

INVENTOR(S) : ERIKA ASANO, ET AL.

It is certified that error appears in the above-identified patent and that said Letters Patent is hereby corrected as shown below:

COLUMN 10:

Line 33, "Fig. 1, (b)," should read --Fig. 1B--.
Line 65, "he" should read --be--.

COLUMN 12:

Line 27, "end" should read --and--.

COLUMN 14:

Line 34, "claim 15," should read --claim 16,--.
Line 37, "claim 14 or 15," should read --claim 15 or 16,--.
Line 51, "claim 14," should read --claim 15,--.
Line 55, "claim 14," should read --claim 15,--.
Line 58, "claim 14," should read --claim 15,--.

Signed and Sealed this

Second Day of June, 1998

*Attest:*

Bruce Lehman

BRUCE LEHMAN

*Attesting Officer*

*Commissioner of Patents and Trademarks*